US011415140B2

(12) United States Patent
Arlandis

(10) Patent No.: US 11,415,140 B2
(45) Date of Patent: Aug. 16, 2022

(54) GAS COMPRESSOR UNIT FOR OIL WELLS

(71) Applicant: Hoerbiger Service Inc., Deerfield Beach, FL (US)

(72) Inventor: Juan Carlos Marie Arlandis, Buenos Aires (AR)

(73) Assignee: Hoerbiger Service Inc., Deerfield Beach, FL (US)

( * ) Notice: Subject to any disclaimer, the term of this patent is extended or adjusted under 35 U.S.C. 154(b) by 0 days.

(21) Appl. No.: 17/084,905

(22) Filed: Oct. 30, 2020

(65) Prior Publication Data

US 2021/0048033 A1 Feb. 18, 2021

Related U.S. Application Data

(63) Continuation-in-part of application No. 15/911,754, filed on Mar. 5, 2018, now abandoned.

(30) Foreign Application Priority Data

May 19, 2017 (AR) ..... P 20170101354

(51) Int. Cl.
*F04D 27/00* (2006.01)
*F04D 25/06* (2006.01)
*F04D 29/70* (2006.01)

(52) U.S. Cl.
CPC ..... *F04D 27/009* (2013.01); *F04D 25/06* (2013.01); *F04D 29/70* (2013.01)

(58) Field of Classification Search
None
See application file for complete search history.

(56) References Cited

U.S. PATENT DOCUMENTS

| | | | | |
|---|---|---|---|---|
| 2,148,638 | A | 2/1939 | Patterson | |
| 2,922,397 | A | 1/1960 | Haanes | |
| 3,990,816 | A | 11/1976 | Kohler et al. | |
| 4,530,646 | A * | 7/1985 | McCoy | F04B 47/028 417/464 |
| 5,076,769 | A | 12/1991 | Shao | |
| 6,200,110 | B1 | 3/2001 | Chou | |
| 7,255,540 | B1 | 8/2007 | Cooper | |
| 8,657,588 | B2 * | 2/2014 | Lund | F04B 9/06 417/258 |
| 9,588,523 | B2 * | 3/2017 | Talton | G05B 19/058 |
| 2002/0061251 | A1 | 5/2002 | McCabe | |
| 2007/0251379 | A1 | 11/2007 | Lund | |
| 2011/0044828 | A1 | 2/2011 | Lund | |
| 2011/0268586 | A1 * | 11/2011 | Rogers | F04B 47/04 417/53 |
| 2015/0233368 | A1 | 8/2015 | Gallaway | |
| 2019/0257306 | A1 | 8/2019 | Blundell et al. | |

FOREIGN PATENT DOCUMENTS

CN 204899812 U 12/2015

* cited by examiner

*Primary Examiner* — Peter J Bertheaud
*Assistant Examiner* — Geoffrey S Lee
(74) *Attorney, Agent, or Firm* — Whitmyer IP Group LLC

(57) ABSTRACT

A compressor unit for oil wells, operating independently from conventional AIB rod pumps, which allows regulated gas extraction to keep the gas pressure constant inside the well and thus allowing the extraction of oil without the inconveniences of traditional pumping systems.

9 Claims, 8 Drawing Sheets

GAS COMPRESSOR UNIT FOR OIL WELLS

RELATED U.S. APPLICATION DATA

This application is a continuation-in-part of U.S. patent application Ser. No. 15/911,754, filed on Mar. 5, 2018, which claims the benefit of Argentine Patent Application Ser. No. P 20170101354, filed May 19, 2017.

BACKGROUND OF THE DISCLOSURE

1. Field of the Disclosure

The present invention relates to the field of machinery, arrangements and devices used in the oil industry, and more particularly it refers to a gas extracting and transferring unit for oil wells that allows reducing pressure in the well annulus depending on the well gas contribution, thus increasing the production of fluid from it. It is emphasized that, this gas compressor unit is completely independent from the systems commonly used for oil extraction, such as, for example, AIB (Independent Pumping Unit, for its abbreviation in Spanish) rod pumps, PCP, electro-submersible pumps, "PLUNGER LIFT" type pumps, etc., and in turn, it allows programming the required pressure in the well.

2. Description of the Prior Art

AIB rod pumps are well known in the oil industry, and are known to allow carrying out mechanical extraction of crude oil from oil wells. Rod pumps are commonly used in many oilfields, and depending on the size of the pump, 5 to more than 50 m3 of a mixture of crude oil and water can generally be produced in 24 hours. The size of the pump is also determined by the depth and weight of the crude oil to be extracted, wherein a deeper extraction requires more energy to move greater lengths of fluid column. A connecting rod-crank mechanism converts the motor rotary motion into a reciprocating vertical movement that moves the pump rod, and produces the typical pitch movement. Thus, the AIB rod pump allows the extraction of crude oil from wells.

As mentioned above, crude oil is accompanied by water and gas in the oilfield. However, the gas in the well can be a major problem for oil extraction. This can occur due to excessive gas pressure inside the well, more particularly in the annulus space between the casing and the pipe. The presence of excessive gas pressure significantly decreases oil production. As a result of the above, some arrangements have been developed that allow extracting the gas from the well annulus to reduce pressure and allow the normal production of crude oil. Currently, beam-rocker compressors are used in mechanical pumping for the transfer of gas, which are mounted and operated in conjunction with the AIB rod pumps, using a large piston and the extraction of gas depending on the number of strokes performed by the AIB.

However, although the use of beam-rocker compressors has proved to be practical in the field of the art, they have drawbacks that limit oil production. One of these drawbacks is the dependence on the movement of the head of the AIB to carry out the extraction of gas, so if compressor requires some type of maintenance, first the AIB should be stopped to carry out said maintenance, which entails losses of time and production. Also, although the gas pressure may vary in the well annulus, conventional compressors constantly extract equal amounts of gas in each stroke, so gas pressure inside the well can vary significantly affecting positively or negatively the production of oil.

One pumping or compressor unit of the type mentioned above is disclosed in U.S. Pat. No. 4,530,646 to McCoy, wherein a cylinder is connected between a stationary pivoting lower end and a walking beam 18 that oscillates about a horizontal axis. Walking beam 18 is part of a conventional pump jack 12, wherein beam 18 is oscillating at a middle part thereof with and end connected to driving assembly 24 and an opposite end connected to horsehead 22 to reciprocate the pump inside the well to pump the oil out of the well. Therefore, the cylinder assembly 34 and piston-rod assembly 36 operate under the movement of the beam 18, and the movement of beam 18 is configured according to the needs of extraction of oil. In other words, the needs for extraction of gas, extracted by the cylinder system 34, are not the same needs of extracting the oil and this may reach operating ranges that are detrimental one respect of the other.

For example, the speed of reciprocating movement of the piston of McCoy is limited to the speed of the pump for extracting the oil. In addition, McCoy cannot control the well pressure because the oil extracting pump cannot be stopped and the speed thereof cannot be reduced all of which would be detrimental for the oil extracting operations.

US Patent Application Publication No. 2015/0233368 A1 to Gallaway discloses a gas compressor comprising a motor, a pinion operatively coupled to the motor, a rack gear driven by the pinion, at least one inlet gas connection and at least one outlet gas connection, and a piston and piston rod reciprocal within a compressor cylinder. The piston rod is coupled to the rack gear, whereby gas entering the compressor cylinder through the at least one inlet gas connection is compressible within the cylinder by the piston and dischargeable from the cylinder through the at least one outlet gas connection. The pump of Gallaway operates in a horizontal position and is mounted in a skid.

It appears that a disadvantage of Gallaway is its durability over time. When working 24 hours and subjected to constant cyclic loads on the flanks of the teeth, all the moving parts suffer from wear, namely pinion, rack, bearings, seals, gaskets. Gallaway requires lubrication and this is a critical point in the drive. It must be checked and changed periodically and it is a critical point because the lube can mix with the gas through package of the axial reciprocating shaft. In addition Gallaway is limited to a short range of speeds. With speeds greater than 20 rpm a much more robust and more powerful system would have to be placed to avoid premature breakage. Gallaway is also limited by the power transmission of the rack and pinion assembly, therefore high geared motor power is required to handle a high pressure range.

US Patent Application Publication No. 2007/0251379 A1 to Lund, granted as U.S. Pat. No. 7,721,641, discloses an air compression apparatus comprised of a frame, a tank, and a motor drive mechanism operably connected to the motor and at least one piston assembly operably connected to the drive mechanism and configured to move within a respective cylinder mounted to the frame. The piston assembly includes (1) a piston body; (2) a piston rod having a hollow bore for receiving outside air and connected to the drive mechanism and to the piston body. The upward travel of the piston body as caused by the drive mechanism opens the piston valve and allows ambient air to be drawn through the hollow bore into the cylinder, and downward travel of the piston body closes the piston valve so as to compress the air within the cylinder. The drive mechanism comprises a motor that moves, through a belt, a wheel connected to the piston rod.

More particularly, as disclosed in column 11 of the above cited U.S. Pat. No. 7,721,641, cylinder 130 not only is provided of lateral oscillation but also the cylinder is caused to oscillate vertically relative to the crank 120 as the crank rotates. The vertical oscillating motion of the cylinder assembly 130 relative to the crank 120 causes a controlled variation in the speed of the piston 140 relative to the cylinder 130 and to the compressed air load within the cylinder, providing for a controlled variation in the leverage applied by the crank 120 against the compressed air load. As the piston 140 is retracted toward the top of the cylinder 130 during part of the rotation of the crank 120, the valve (not shown) at the bottom of the piston 140 is pulled open by the action of a vacunn1 created in the bottom chamber of the cylinder 130, so that ambient air then passes through the hollow piston rod 170 and open valve into the bottom chamber. When the piston 140 has reached the top of its stroke, the valve at the bottom of the piston is closed, and the air in the bottom chamber is compressed by the downward movement of the piston 140 and driven through a check valve 180 into the pressure tank 102 or into the chamber in the cylinder 130 above the piston 140. During the downward travel of the piston 140, a valve 142 at the top of the piston admits air through the hollow piston rod 170 into the upper chamber.

It is clear that Lund discloses a structure to compress only air entering through a bore in the piston rod 170, with a valve at the piston 140 to direct the entering air to the upper chamber or to the lower chamber of the cylinder. That is, only one input is provided for air, not operable to admit and exit gas by different separate input and output ports. Lund is not designed for suction of gas from an oil well and for directing the gas to a circulation circuit or gas production line and/or related reservoirs.

By virtue of the above, it would be very convenient to have a new arrangement, device, machinery or means that may allow extraction of gas from the oil well without affecting the conditions of production of crude oil, allowing in turn an adequate extraction of gas according to pressures existing in the well.

SUMMARY OF THE DISCLOSURE

It is therefore an object of the present invention to provide a compressor unit for oil wells that allows gas extraction independently from the AIB rod pumps.

It is still another object of the present invention to provide a compressor unit that allows maintaining a constant gas pressure in the well, since it has a pressure switch, pressure transmitter and frequency converter that controls the speed of the piston as a function of the gas flow rate to be extracted.

It is also another object of the present invention to provide a compressor unit that, owing to its structural configuration, has a longer useful life and efficiency of the compressor unit due to minor maintenance and repairs It is another object of the present invention to provide a gas compressor unit for oil wells that make it possible for pressure in the well to be programmable.

It is still another object of the present invention to provide a gas compressor unit for oil wells comprising a driving system to actuate a piston-cylinder assembly wherein the speed of driving system can be varied by the VFD according to the well conditions, wherein the required pressure in the well can be controlled, by monitoring the pressure with a transmitter and by varying the speed of the equipment and wherein the gas pump unit is absolutely independent of any oil pump unit that is simultaneously operating in the same well.

It is even another object of the present invention to provide a gas compressor unit for oil wells comprising a driving system to actuate a piston-cylinder assembly wherein no lubrication in the driving mechanisms are required and wherein pressure sensors and security valves are provided for the event that the gas in the well suddenly increases, in which case the valves open to direct the excess pressure to a gas venting tube spaced apart from the pump or compressor components.

It is still another object of the present invention to provide a gas compressor unit for oil wells comprising at least one compressor cylinder having at least one gas inlet in connection with the well, at least one gas outlet, one pivoting lower end and a double-acting piston whose drive shaft is connected to a drive motor, which can be an electric, hydraulic or combustion motor, said drive motor being connected to a pressure transmitter operatively connected to a pressure switch which is in turn operatively connected to the well.

It is also an object of the present invention to provide a gas compressor unit for oil wells comprising:

a base, a stand element in the base, a rotary drive motor mounted in an upper end of the stand element;

an output rotary shaft of said rotary drive motor;

a connecting rod having an end affixed to said output rotary shaft to rotate with the output rotary shaft, and an opposite end including a first bearing;

a connection element rotatably connected to said opposite end of the connecting rod through the first bearing;

at least one compressor cylinder having a first end and a second end, with the second end pivotally connected to a support fixed in the base, and a double-acting piston having a driving shaft which is connected to said connection element for moving the double-acting piston with reciprocating movement, at least one first gas inlet/outlet port in the first end of the compressor cylinder, at least one second gas inlet/outlet port in the second end of the compressor cylinder, a valves framework affixed to the base, the valves framework having a first framework port connected by a first flexible conduit to the first gas inlet/outlet port of the compressor cylinder and a second framework port connected by a second flexible conduit to the second gas inlet/outlet port of the compressor cylinder, a discharge branch and a suction branch, the discharge branch having a pair of discharge check valves and a discharge branch port between the discharge check valves, the suction branch having a pair of suction check valves and a suction branch port between the suction check valves, a liquid separator having a first end connected to the suction branch port and a second end connected to a suction hose, a gas venting tube connected to security valves and between the liquid separator and the discharge branch port.

BRIEF DESCRIPTION OF THE DRAWINGS

For greater clarity and understanding of the object of the present invention, it has been illustrated in several figures, in which the invention has been represented in one of the preferred embodiments, all by way of example, wherein.

DESCRIPTION OF THE PREFERRED EMBODIMENTS

Figure 1:
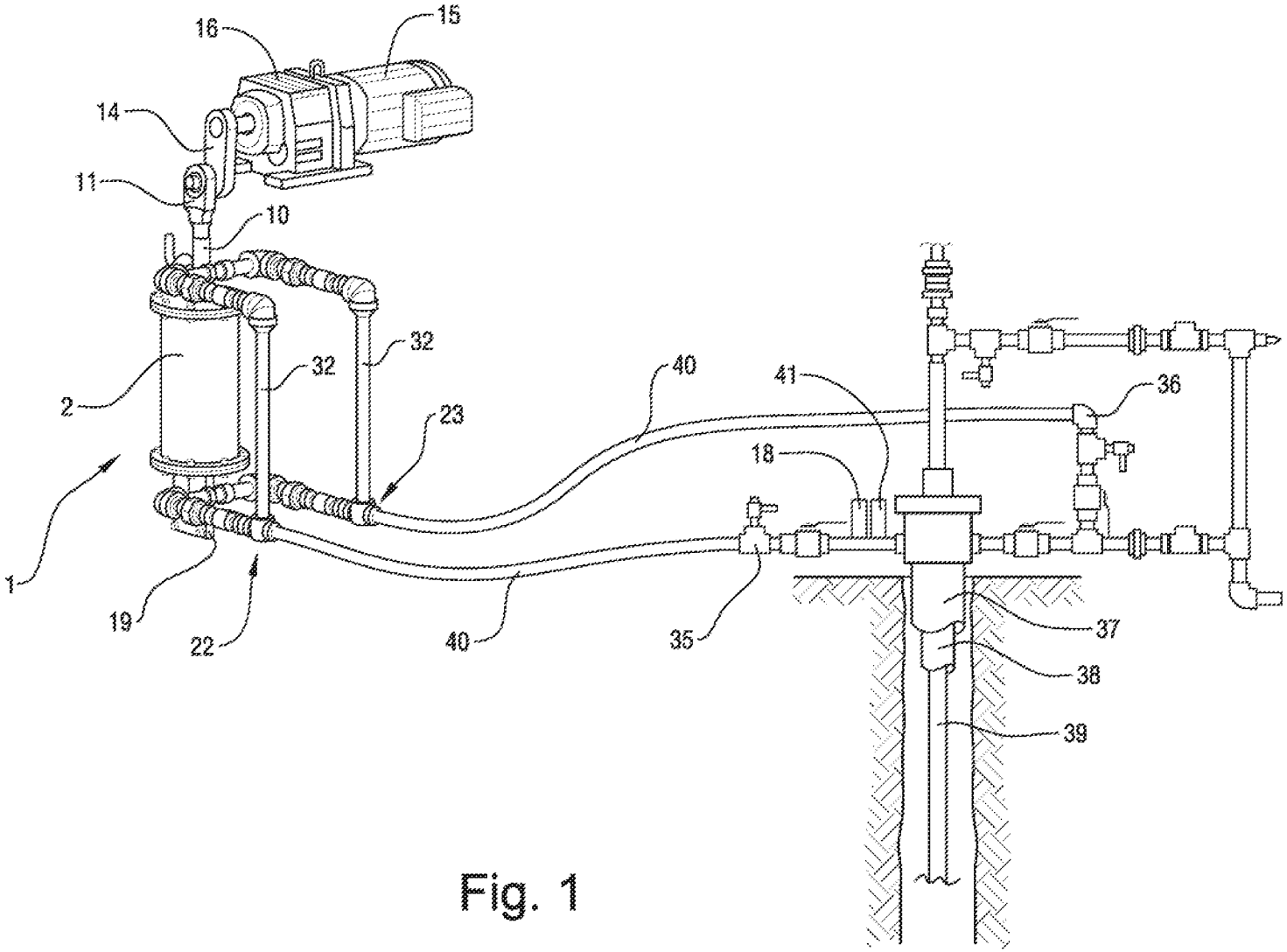
FIG. 1 shows an exemplary schematic view of the gas compressor unit for oil wells according to the present invention, wherein it has been illustrated, merely by way of example, in connection with the corresponding parts installed in the well.
Figure 2:
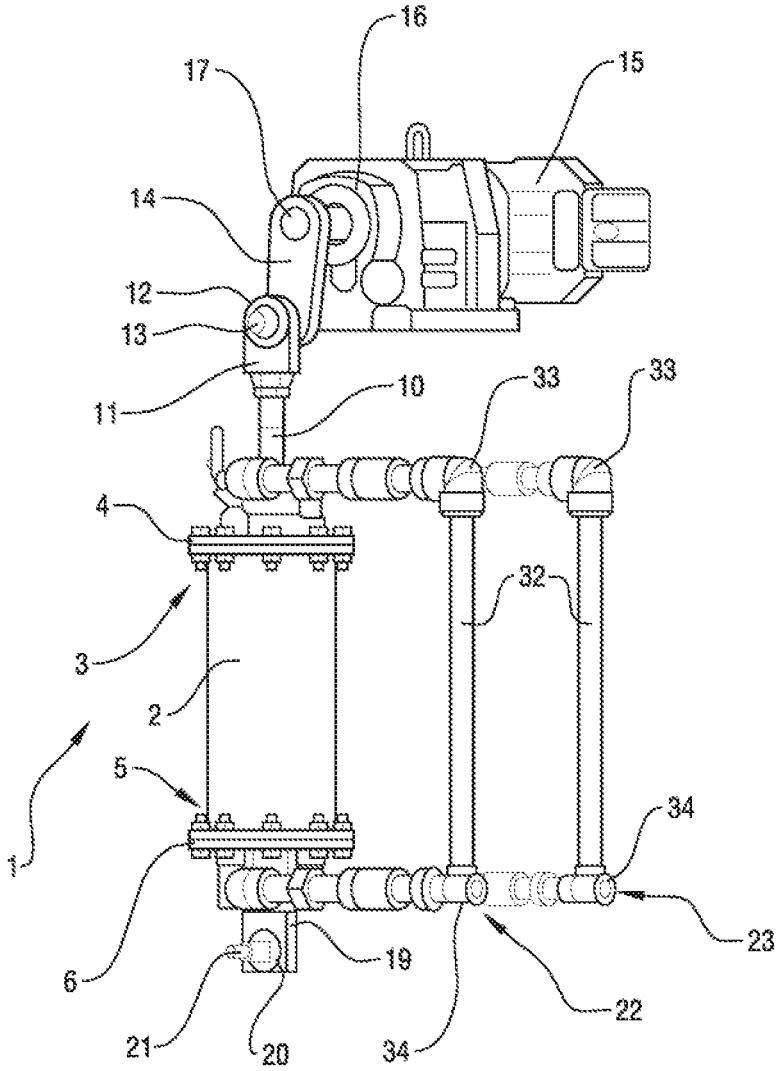
FIG. 2 shows a perspective view of the gas compressor unit for oil wells according to the present invention.

Referring now to the figures, it is seen that the invention consists of a new gas compressor unit for oil wells which is an unit independent from the AIB rod pumps that allows regulated extraction of gas to keep the gas pressure constant inside the well and thus allow the extraction of oil without any inconvenience. For exemplary purposes and to further improve the understanding of the present invention, FIG. 1 illustrates the compressor unit in connection with the respective parts of the well. As mentioned above, as it is an exemplary scheme, both the separation distances and the dimensions of the illustrated components have been illustrated disproportionately, it being understood that this is not a limitation for the invention and that in practice it correctly adapts to the demands of the place.

Thus, and according to FIGS. 1 to 4, the compressor unit for oil wells of the present invention is indicated by the general reference 1 and comprises at least one compressor cylinder 2 having an upper part 3 on which an upper sealing cover 4 is mounted and a lower part 5 on which a lower sealing cover 6 is mounted, both covers 4 and 6 being fixed to the cylinder 2 by respective bolts, pins or similar fixing elements. Likewise, said compressor cylinder 2 comprises an upper gas cylinder inlet/outlet mouth 7 provided in the upper part 3 and a lower gas cylinder inlet/outlet mouth 8 provided in the lower part 5.

Internally, the compressor cylinder 2 comprises a double-acting piston 9 whose drive shaft 10 passes through the upper cover 4 and has a proximal end that has a connection element 11 provided with a bearing 12 on which a connecting shaft 13 is fixed, said connecting shaft 13 allowing the connection between said driving shaft 10 and a respective connecting rod 14 which is connected to a drive motor 15-reducer 16 by means of the shaft 17 of the latter. The drive motor 10 may be a combustion, hydraulic or electric drive motor, but it is preferably an electric motor which is operatively connected to a pressure switch 18 by a pressure transmitter 41 which is used to control the speed of said motor-reducer, the pressure switch 18 being used to set or establish the start/stop pressure and being operatively connected to the well, more particularly to the annulus space between the casing and the extraction pipe. In this way, the pressure in the well can be programmable without any inconvenience, this not being possible by any of the conventional devices of the prior art since they operate with the beam pump stroke and there is no way of being able to program the pressure required in the well.

The pressure transmitter 41 measures the pressure in the annulus and regulates the rotational revolution of the motor so that the piston moves at a greater or lower speed inside the compressor cylinder. This allows the extraction of gas in accordance with gas pressure existing inside the annulus. By way of example, but not limiting the invention, if the gas pressure existing within the annulus space exceeds the maximum pressure limit necessary to allow the extraction of oil, the pressure transmitter 41 sends a signal to the variable speed drive of the motor so that it rotates at higher revolutions and thus generating a greater speed in the piston movement, consequently extracting a greater amount of gas from the annulus in order to reduce the pressure existing in it. Likewise, the use of the pressure transmitter makes it possible to know the pressure in the annulus and to maintain the ideal pressure therein on a constant basis. In turn, owing to the pressure switch arrangement and the pressure transmitter, the required pressure inside the well can be programmable according to the operating conditions of the moment.

For its part, the connecting rod 14 provides an eccentric movement rectilinear to the drive shaft 10 of the piston 9 which moves longitudinally inside the compressor cylinder 2 to allow the entry of gas as well as, simultaneously, its compression and discharge. When said driving shaft 10 performs a rectilinear eccentric movement, it causes the compressor cylinder 2 to pivot in a tilting manner. To facilitate the tilting movement of the compressor cylinder 2, a pivoting lower end is provided which comprises a lower arm 19 provided with a bearing 20 through which a shaft 21 passes whose ends are fixed to respective lateral support plates (not shown) provided with bearings (not shown) and which are mounted on a frame (not shown) that supports the general structure of the unit of the invention. In this way, pivoting from the lower end is allowed accompanying the eccentric rectilinear movement of the drive shaft 10 and the tilting movement of the cylinder 2.

On the other hand, the invention comprises at least one main gas inlet 22 in connection with the well annulus and at least one main gas outlet 23 in connection with the gas production line and/or related reservoirs. Although, according to the direction illustrated in FIGS. 1 to 4, it has been indicated that the main gas inlet 22 is on the right, while the main gas outlet is on the left, this does not imply that the invention is limited to said configuration, but other arrangements can be considered and used without any inconvenience.

The main gas inlet 22 bifurcates and projects into a lower gas inlet 24 which is in connection with the lower gas cylinder inlet/outlet 8 of the lower part 5 of the cylinder 2 through a unidirectional check valve 25, and in a upper gas inlet 26 which is connected to the upper gas cylinder inlet/outlet 7 of the upper part 3 of the compressor cylinder 2 by another unidirectional check valve 27. In turn, the present invention has a lower gas outlet 28 which is connected to the lower gas cylinder inlet/outlet 8 by a unidirectional check valve 29 and an upper gas outlet 30 which is connected to the upper gas cylinder inlet/outlet 7 through another unidirectional check valve 31, both gas outlets 28 and 30 extending and being connected to the main gas outlet 23.

It is noted that projections and bifurcations mentioned above include tubes or pipes 32 as well as bends 33, shut-off valves, connectors, flanges, seals, stuffing boxes, etc., as best illustrated in FIGS. 1 to 4. Likewise, the main gas inlet 22 and the main gas outlet 23 have connectors 34 and are connected to the well and reservoir/production line respectively by means of a conduit 40 or conduits such as duct(s), pipe(s), hose(s) or the like. More particularly, and in accordance with FIG. 1, it can be seen that the main gas inlet 22 is in connection with a suction gas outlet 35 from which the gas of the well annulus comes, while said main outlet of gas 23 is in connection with a discharge gas inlet 36 which is projected towards the gas production line and/or related reservoirs. Also, in said FIG. 1 some components of those parts that are usually used in wells have been illustrated for exemplary and helping purposes for a better understanding of the present invention. Wherein, said components that are illustrated are the "casing" 37, pipe 38 and rod 39 among many others.

Figure 3:
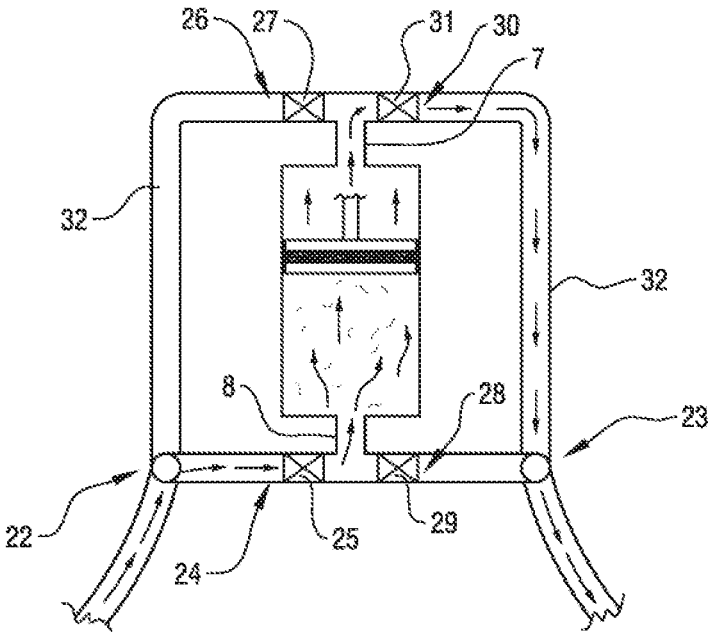
FIGS. 3 and 4 show a sectional view of the gas compressor unit according to the present invention, wherein the direction of advancement of the piston can be observed allowing gas entry and simultaneous compression/discharge thereof.

By way of example, but not limiting the invention, according to what is illustrated in FIG. 3, when the piston 9 moves upwards, the gas entering through the main gas inlet 22 is projected entering the cylinder 2 through of the lower gas inlet 24—lower gas inlet/outlet 8. Simultaneously, it can be seen that the gas that was previously inside the cylinder is compressed and discharged through the upper gas cylinder inlet/outlet 7, passing through the upper gas outlet 30 and finally being discharged through the main gas outlet 23.

Figure 4:
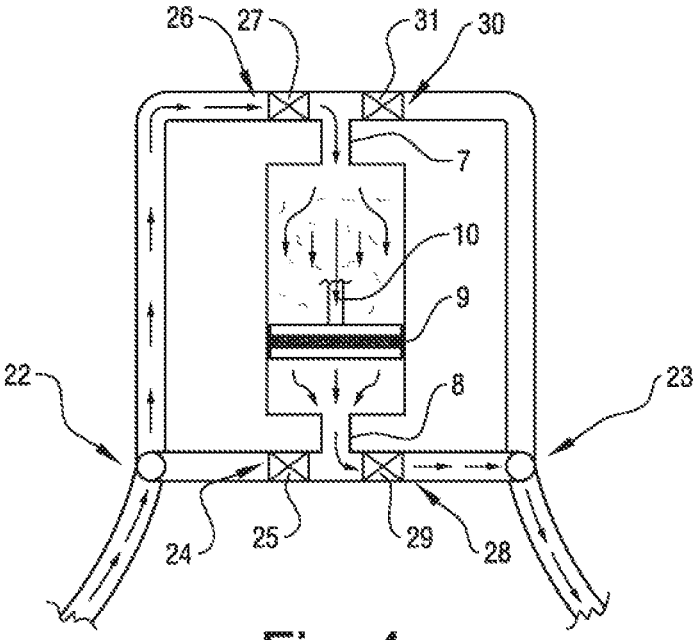
Figure 5:
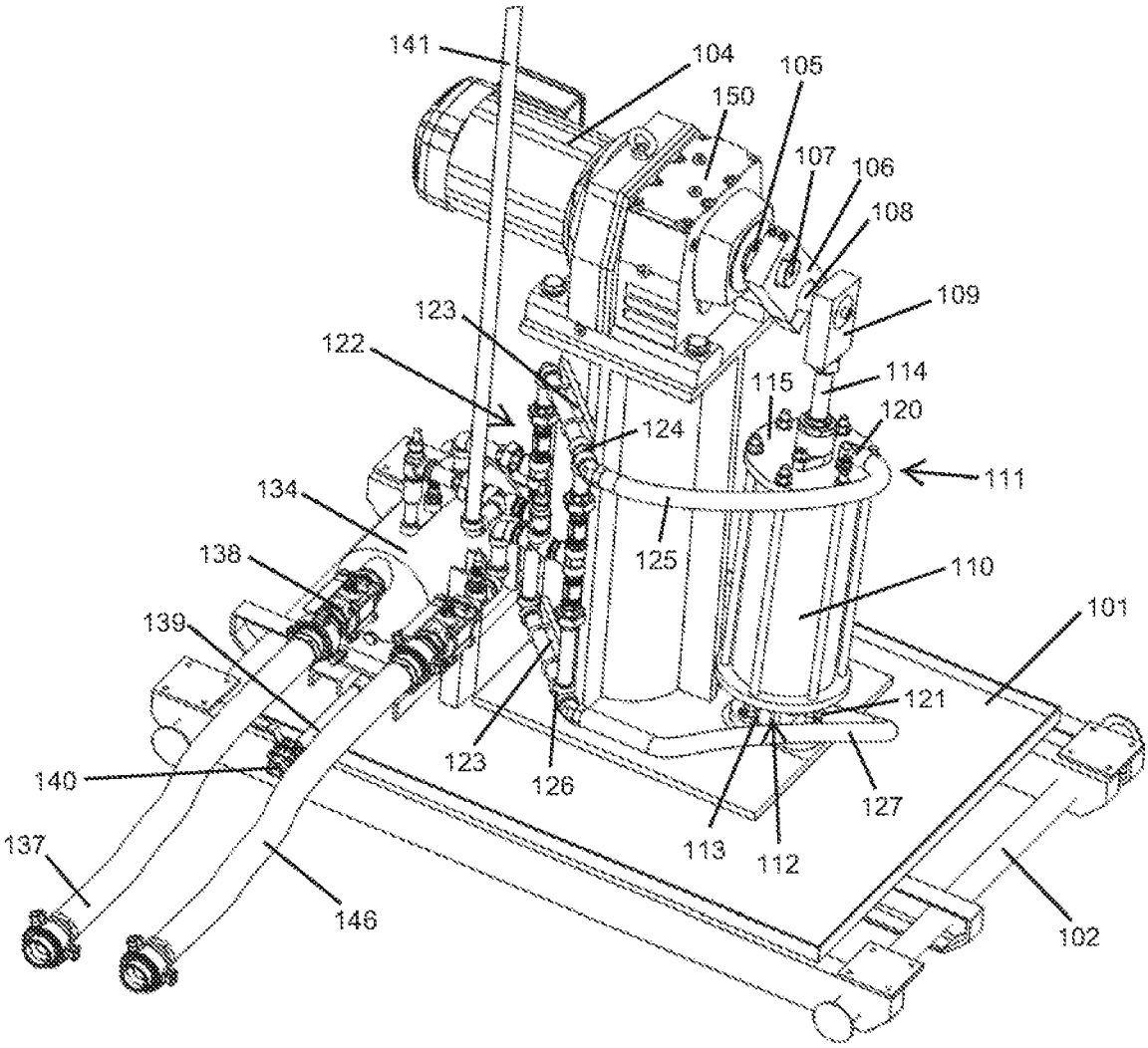
FIG. 5 shows a perspective view of another embodiment of the invention.
Figure 6:
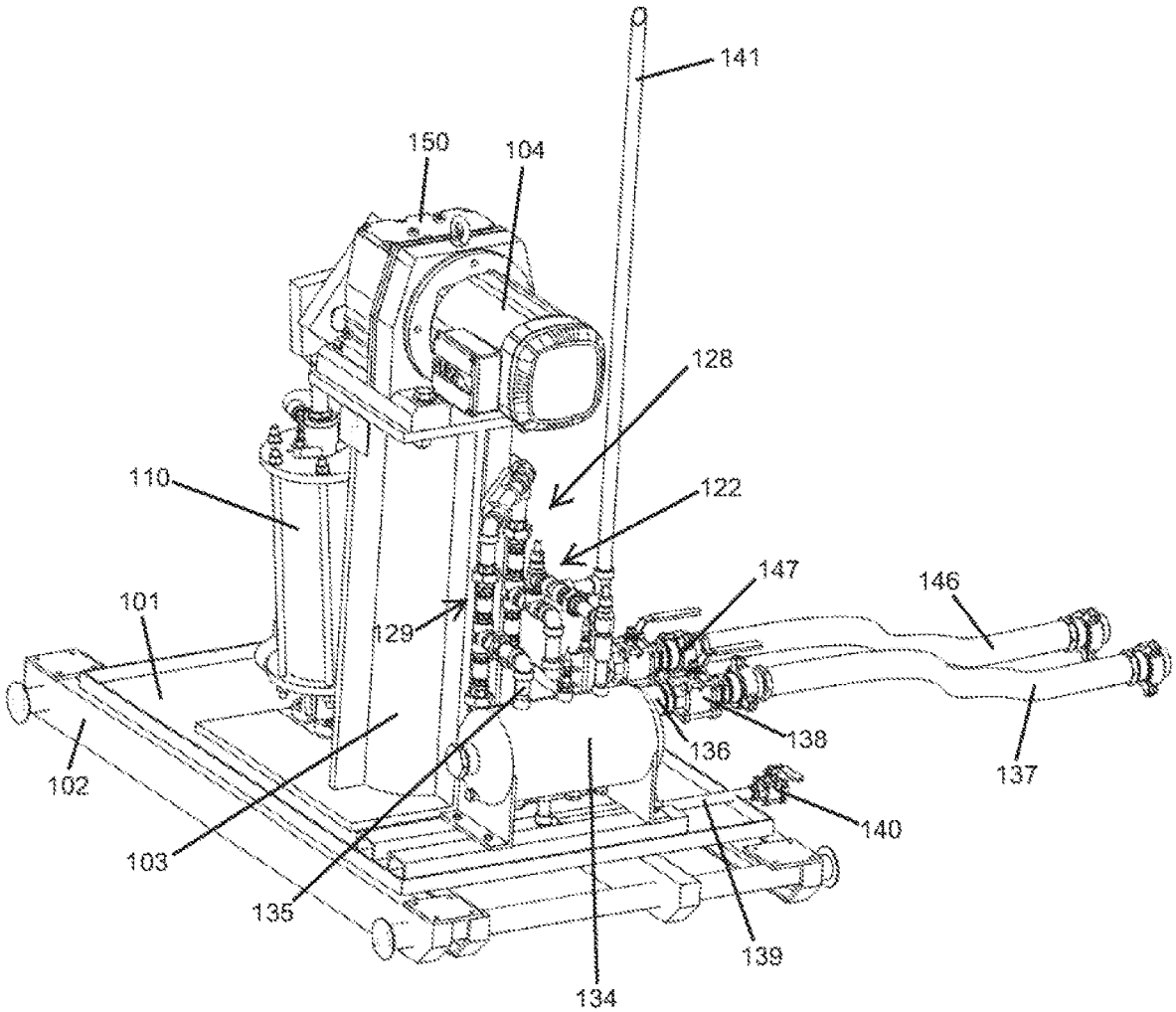
FIG. 6 shows another perspective view of the embodiment of FIG. 5.
Figure 7:
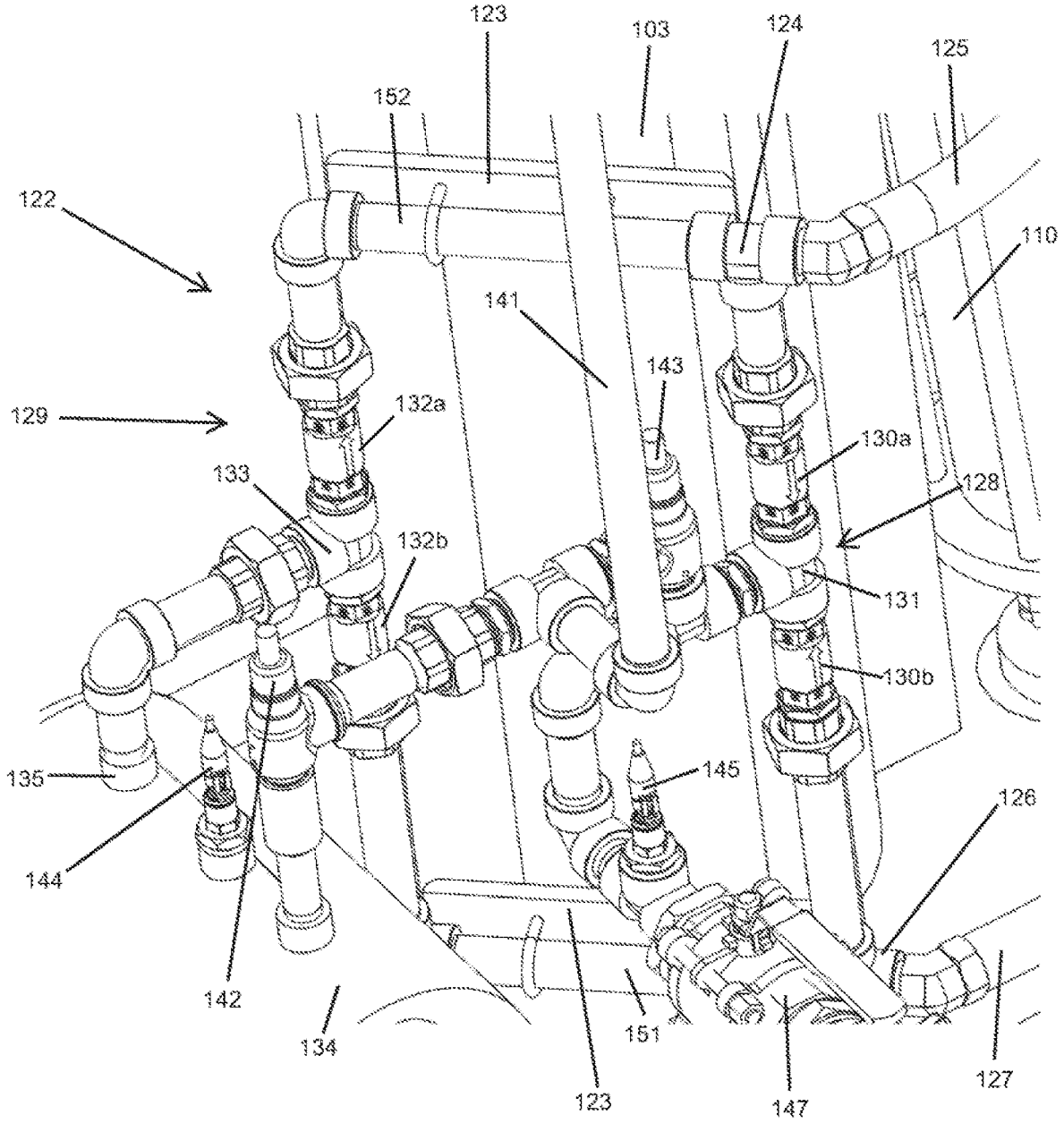
FIG. 7 shows a detailed perspective view of the embodiment of FIG. 5, where the valves framework is shown in more detail.

On the other hand, FIG. 4, when the piston 9 moves down, the gas entering through the main gas inlet 22 is projected entering the cylinder 2 through the upper gas inlet 26—upper gas cylinder inlet/outlet 7. Simultaneously, it can be seen that the gas that previously entered the cylinder, according to FIG. 3, is compressed and discharged through the lower gas cylinder inlet/outlet 8, passing through the lower gas outlet 28, and finally being discharged through the main gas outlet 23.

The use of the unidirectional check valves 25, 27, 29 and 31, define the direction of gas flow for both the entry and exit from/to the cylinder, thus avoiding the possible return of the gas. Likewise, both the direction of gas circulation and the main gas inlet and outlet are not limited to what has been described above, but can be adapted for having other configurations without any inconvenience.

According to the embodiment shown in FIGS. 5 to 8, the unit has been remarkably improved by removing the drawbacks of having long hoses 40 constantly moving as a result of the pivoting motion of cylinder 2. In some situations, the unit is mounted at a distance of 5 to 10 meters from the oil well and these long hoses may be damaged by the friction against the soil, which leads to wearing of the hoses and dangerous gas leaks by punctures. This is not a problem that must be faced by Lund, cited above, that receives outside air by the hollow bore of the piston rod. There are no connections to any spaced apart oil well.

Another question that the embodiment of FIGS. 5 to 8 has been addressed, is that a gas venting system is necessary for any situation that an unexpected dangerous increase of pressure is produced in the circuit of conduits and hoses. Security and pressure release valves have been provided to control the pressure in the circuit which valves are associated to a venting system. This was a challenge because the circuit and gas conduits in the embodiment of FIGS. 1-4, were oscillating during operation because of the pivoting movement of the cylinder. Since a gas venting cannot be placed close to, but spaced apart from, the motor and mechanism moving parts, there was mostly impossible to place a long venting conduit in such moving parts. Such construction would have produced breaks in any oscillating long venting tube.

As shown in FIGS. 5 to 8 the unit of this embodiment comprises a base 101 mounted on a frame or modular frame chassis 102, at least one stand element 103 in the base 101, that can be a pillar or a hollow pillar to house components, and a rotary drive motor 104 mounted in an upper end of stand element 103. Said rotary drive motor 104 comprises an output rotary shaft 105 that is connected to a connecting rod 106 having an end 107 affixed to said output rotary shaft 105 to rotate with the output rotary shaft 105, and an opposite end including a first bearing 108. A connection element 109 is connected to said opposite end of the connecting rod 106 through the first bearing 108. Rotary drive motor 104 is connected to a pressure transmitter operatively connected to a pressure switch which in turn is operatively connectable to the well, as described with respect to the embodiment of FIG. 1. Additionally, said rotary drive motor is an electric motor and is connected to a motor gear reducer 150.

Figure 9:
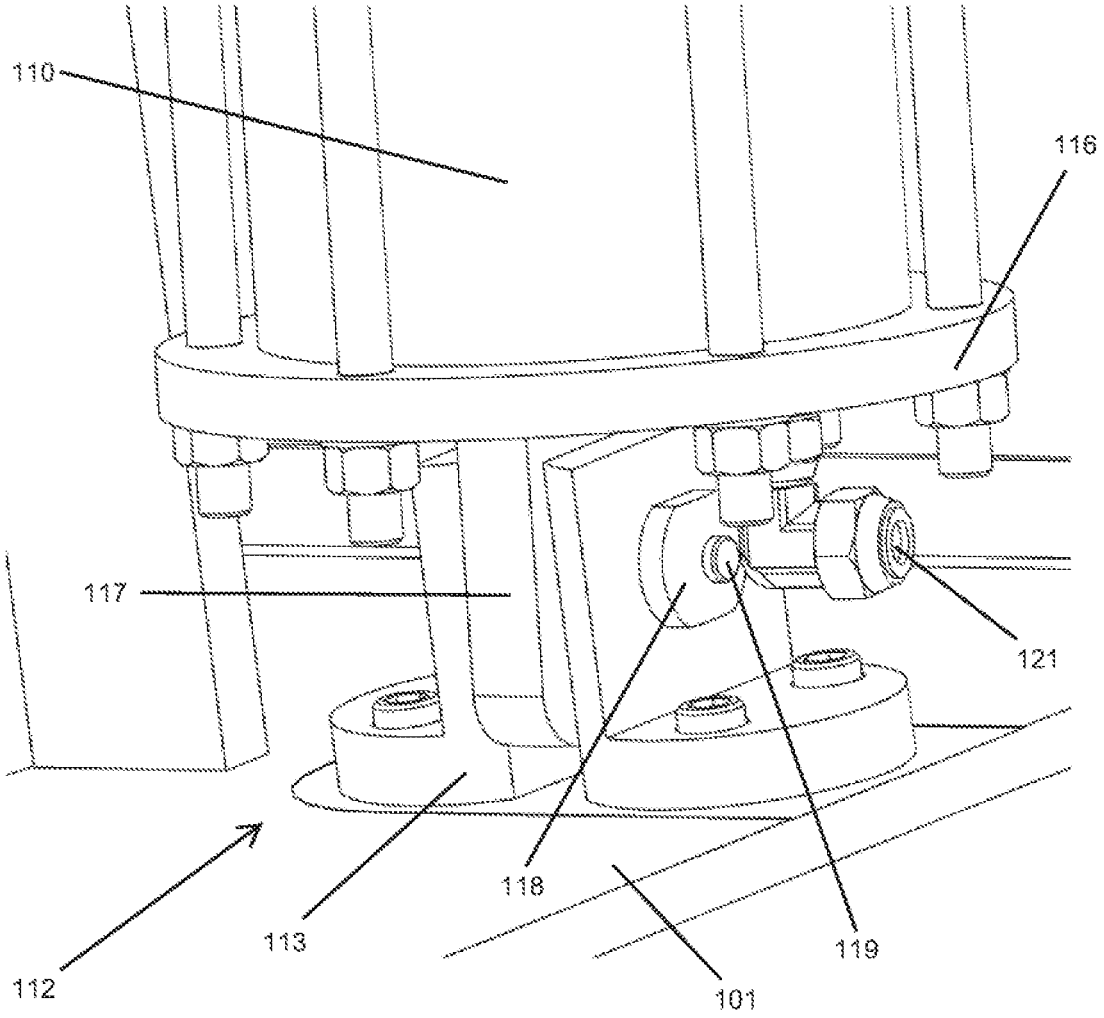
FIG. 9 shows a detailed view of a lower section or lower or second end of the compressor cylinder wherein the oscillating mounting of the cylinder in the base is shown.

Moreover, the invention provides at least one compressor cylinder 110 having a first end 111 and a second end 112, with the second end 112 pivotally connected to a support 113 fixed in the base 101, and a double-acting piston (not shown) inside the cylinder, having a driving shaft 114 which is connected to connection element 109 for moving the double-acting piston with reciprocating movement. It should be understood that the internal configuration of the compressor cylinder 110 is similar to the structural configuration of said compressor cylinder 2 illustrated in FIGS. 3 and 4. Additionally, compressor cylinder 110 comprises an upper sealing cover 115 and a lower sealing cover 116, both covers 115 and 116 being fixed to the cylinder 110 by respective bolts, pins or similar fixing elements. As shown in FIG. 9, second end 112 of compressor cylinder 110 has a lower arm 117 provided with a second bearing 118 to pivot around a shaft 119 in support 113 that is stationary affixed to base 101. This allows the oscillatory or pivoting movement of compressor cylinder 110.

According to the present embodiment, at least one first gas inlet/outlet port 120 in first end 111 of compressor cylinder 110 and at least one second gas inlet/outlet port 121 in second end 112 of compressor cylinder 110, are provided. A valves framework 122 is affixed to base 101, preferably to stand element 102 through respective supports 123 with clamps. A lower branch 149 and an upper branch 149, FIG. 8, comprise respective lower tube or conduit 151 and upper tube or conduit 152, both of them clamped at lower and upper supports 123. Valves framework 122 has a first framework port 124 connected by a first flexible conduit 125 to first gas inlet/outlet port 120 of compressor cylinder 110, and a second framework port 126 connected by a second flexible conduit 127 to second gas inlet/outlet port 121 of compressor cylinder 110.

Furthermore, the invention provides a discharge branch 128 and a suction branch 129, wherein discharge branch 128 has a pair of discharge check valves 130*a*, 130*b* and a discharge branch port 131 between discharge check valves 130*a*, 130*b*. Suction branch 129 has a pair of suction check valves 132*a*, 132*b* and a suction branch port 133 between suction check valves 132*a*, 132*b*. The discharge check valves and the suction check valves are unidirectional check valves, such that they are arranged as illustrated to define a fluid flow circulation, preferably only gas but gas with some humidity degree and even liquid. The sense of circulation will be defined by the movement of the piston inside the cylinder as it will be disclosed below. Connection between valves and ports are made by respective couplings, seals, nipples, conduits or tubing, which are illustrated while not precisely indicated by reference numbers to keep the drawings clear.

On the other hand, the invention provides a liquid separator 134 having a first end 135 connected to suction branch port 133 via respective curved couplings, conduits, tubing, seals, unions or nipples, and a second end 136 connected to a suction hose 137 through a spigot, closing or shutoff valve 138. Suction hose 137 is connected to the well as is hose 40 with suction gas outlet 35 shown in FIG. 1. Gas, occasionally containing debris, water and oil, is sucked from the oil well through hose 137 and directed to separator 134 wherein liquid and debris is separated and discharged through a lower conduit having a shutoff or closing valve 140.

The present invention further comprises a gas venting tube 141 connected to security valves and between liquid separator 134 and discharge branch port 131. More particularly, said security valves are a first security valve 142 connected between liquid separator 134 and gas venting tube 141, and a second security valve 143 connected between gas venting tube 141 and discharge branch port 131. Furthermore, the invention provides a suction pressure sensor 144 that is connected to at least one of liquid separator 134, as shown, and suction branch port 133, and a discharge pressure sensor 145 that is connected between a discharge hose 146 and second security valve 143. Discharge hose 146 is connected to a shutoff or closing valve 147 which in turn is operatively connected to discharge branch port 131, with discharge pressure sensor 145 being connected between valve 147 and port 131. Connections between said ports, security valves, sensors and gas venting tube 141, are made by respective connectors, nipples, seals, conduits, tubings and the like as it is clearly illustrated.

As shown, the arrangement of the security valves, the sensors and the gas venting tube allows venting of gas and excessive pressure in the event of an unexpected increasing or peak of pressure within the circuit. Thus, the invention remarkably improves the security of the installation and provides a solution to the above mentioned drawbacks relating to the movement of sensible parts in the embodiment of FIGS. 1-4. The invention also solves the problems of friction of hoses in the soil, premature wearing of hoses and moving parts.

Figure 8:
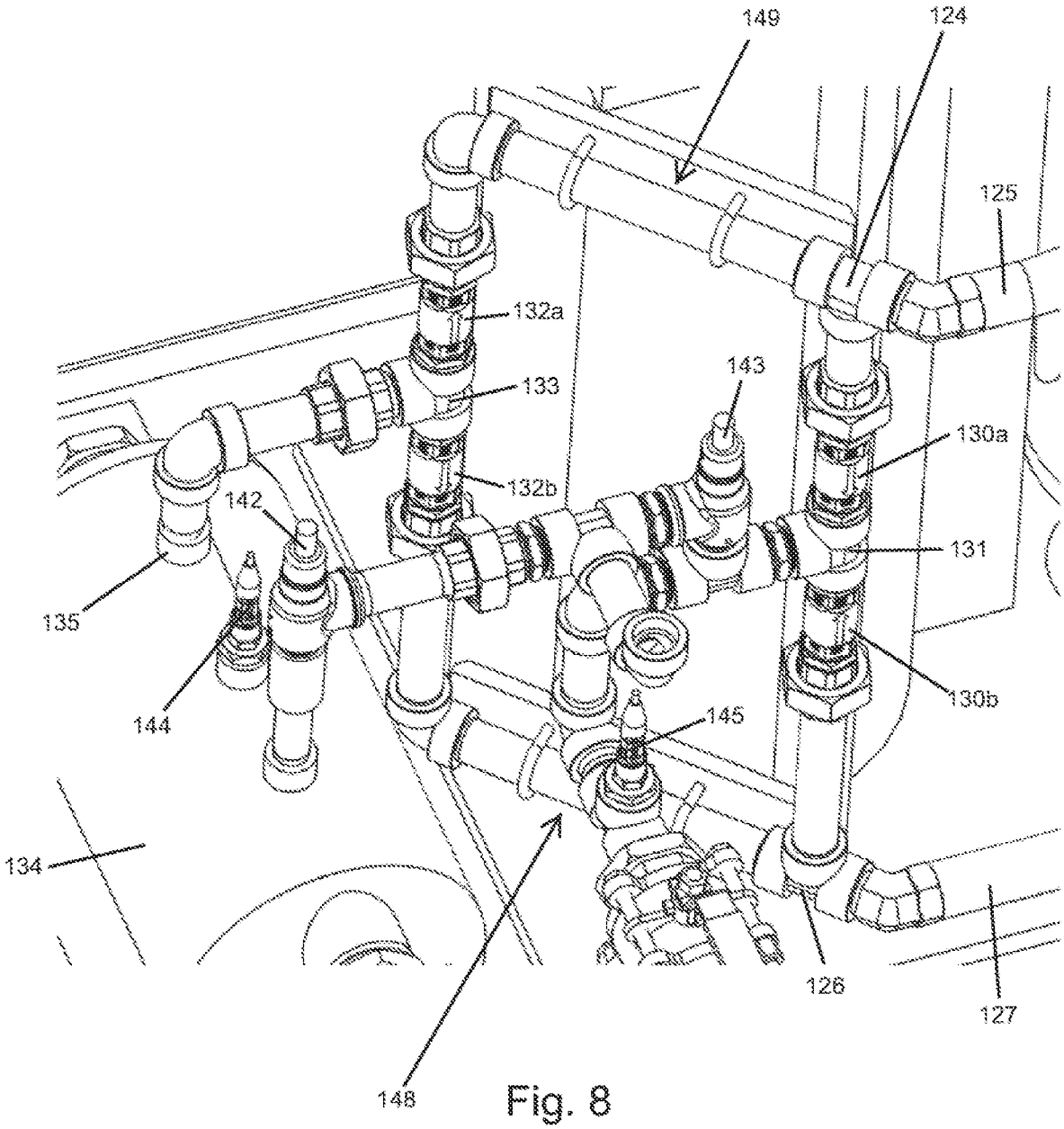
FIG. 8 shows another view of the embodiment of FIG. 7, where a venting gas tube has been removed to allow a better view of the valve's framework.

A shown in FIG. 8, where venting tube has been removed for clarity purposes, suction check valve 132*a* is located to allow the fluid flow upwardly, with suction check valve 132*b* being arranged to permit the fluid flow downwardly as indicated by the arrows. On the other hand, discharge check valve 130*a* is arranged to allow fluid flow downwardly and discharge check valve 130*b* is mounted to permit fluid flow upwardly, as indicated by the arrows.

In operation, 1) when the double-acting piston moves downwardly it means that inner chamber (not shown) at upper end of the cylinder is expanding and therefore sucking fluid:

a) the fluid is sucked via hose 125 and suction branch 129, the liquid is separated in separator 134, fluid flows to suction branch port 133 and then to suction check valve 132*a*. This is because the piston is compressing the fluid downwardly in the lower chamber (not shown) of the cylinder, and the pressure generated in lower branch 148 is higher than in upper branch 149, therefore the fluid coming from separator 134 cannot pass through suction check valve 132*b*, that is closed, and is directed to suction check valve 132*a*, that is open;

b) the fluid passes through suction check valve 132*a*, continues to pass through first framework port 124, and flows by first flexible conduit 125 to first gas port 120 of the compressor cylinder 110 and enters the upper chamber of the cylinder that is expanding, thus gas port 120 operates as an inlet for the fluid;

c) at the other end of the cylinder, with the piston moving downwardly, fluid sucked into the lower chamber (not shown) of compressor cylinder 110 is compressed by the piston and is directed to second gas port 121 that now operates as an exit for the fluid, and the fluid exists via second flexible conduit 127, to discharge branch 128, reaches second framework port 126 and flows to discharge check valve 130*b*, passes through discharge branch port 131 and is discharged via valve 147 and discharge hose 146.

2) when the double-acting piston moves upwardly it means that inner chamber (not shown) at lower end of the cylinder is expanding and therefore sucking fluid:

d) the fluid is sucked via hose 127 and suction branch 129, the liquid is separated in separator 134 and the fluid flows to port 133. Since valve 132*a* is closed, fluid passes through suction check valve 132*b*, flows through conduit 151, passes through second framework port 126 and continuous by second flexible conduit 127 to enter second gas port 121 to lower chamber of the compressor cylinder. Now, port 121 operates as an inlet port;

e) The piston follows moving upwardly and compresses the fluid that is in the upper chamber which fluid is discharged through first gas port 120, operating now as an exit port. The fluid is directed through first flexible conduit 125, passes through first framework port 124, and continuous to discharge check valve 130*a*. The fluid passes through valve 130*a* because it is open while valve 130*b* is closed. The fluid is finally exited through discharge branch port 131 and discharge hose 146. In any event, hose 146 is connected to any gas collecting installation as is in the case of FIG. 1.

These steps are cyclically repeated with the upward and downward movement of the piston. The fluid discharged through the discharge hose, is prevented from returning to liquid separator 134 because of the operation of suction check valves 132*a*, 132*b*.

By way of example, but not limiting the invention, some tables are attached showing the results obtained by the compressor unit of the invention:

Discharge flow tables: thousands of cubic feet of gas under standard conditions per day (MSCF/D–thousand standard cubic feet per day)

Calculation equation: $8.73\times10^{-5}\times D^2\times L\times RPM\times Q=PS;$ Calculations should be made with absolute pressures.

| Piston diameter 6" | | | | |
|---|---|---|---|---|
| Piston net stroke | P suction | Revolution per minute (RPM) in gear box outlet | | |
| (inches) | (psig) | 10 | 20 | 30 |
| 10 | 0 | 4.7 | 9.42 | 14.1 |
| | 5 | 6.3 | 12.6 | 18.8 |
| | 10 | 7.8 | 15.7 | 23.5 |
| | 15 | 9.4 | 18.8 | 28.3 |
| | 20 | 11.0 | 21.9 | 32.9 |
| | 25 | 12.6 | 25.1 | 37.7 |
| | 30 | 14.1 | 28.3 | 42.4 |

| Piston diameter 8" | | | | |
|---|---|---|---|---|
| Piston net stroke | P suction | Revolution per minute (RPM) in gear box outlet | | |
| (inches) | (psig) | 10 | 20 | 30 |
| 16 | 0 | 13.4 | 26.8 | 40.2 |
| | 5 | 17.9 | 35.8 | 53.6 |
| | 10 | 22.3 | 44.7 | 67.0 |
| | 15 | 26.8 | 53.6 | 80.4 |
| | 20 | 31.2 | 62.5 | 93.7 |
| | 25 | 35.7 | 71.5 | 107.2 |
| | 30 | 40.2 | 80.4 | 120.7 |

Torque table: (depending on pressure difference, diameter and effective stroke of the piston) Newton-meter Calculation equation: $\#N\text{-}m=4.44\times10^{-2}\times D^2\times L(Pd-Ps)$;

wherein, pressure difference: Discharge pressure−Suction pressure.

| Pressure difference (psi) | Piston diameter: 6 inches | | | | Piston diameter: 8 inches | | | | |
|---|---|---|---|---|---|---|---|---|---|
| ΔP | 10 | 12 | 14 | 16 | 10 | 12 | 14 | 16 | |
| 5 | 80 | 96 | 112 | 128 | 142 | 170 | 199 | 227 | |
| 10 | 160 | 192 | 224 | 256 | 284 | 341 | 398 | 454 | |
| 15 | 240 | 287 | 335 | 383 | 426 | 511 | 596 | 681 | |
| 20 | 319 | 383 | 447 | 511 | 568 | 681 | 795 | 909 | DETAILS |
| 25 | 399 | 479 | 559 | 639 | 710 | 852 | 994 | 1136 | APPLICABLE |
| 30 | 479 | 575 | 671 | 767 | 852 | 1022 | 1193 | 1363 | IN THE |
| 35 | 559 | 671 | 783 | 894 | 994 | 1193 | 1391 | 1590 | FIELD |
| 40 | 639 | 767 | 894 | 1022 | 1136 | 1363 | 1590 | 1817 | |
| 45 | 719 | 862 | 1006 | 1150 | 1278 | 1533 | 1789 | 2044 | |
| 50 | 799 | 958 | 1118 | 1278 | 1420 | 1704 | 1988 | 2272 | |

Well Tests

Prior to the Use of the Compressor Unit of the Invention:

The selected well had a production of 02 BO×0 BW, in October 2016, taking the following physical measurement:

| | | Production before compressor | | | | | Current production with compressor | | | | | | | |
|---|---|---|---|---|---|---|---|---|---|---|---|---|---|---|
| Compressor | Well | Oil | Water | P Tbg (psi) | P Csg (psi) | Manometric | Oil | Water | P Tbg (psi) | P Csg (psi) | Manometric | Incremental de Oil | Suction | Remark |
| BMCG - GMP-09 | 4453 | 2 | 0 | 10 | 3 | 10-280 psi/ 2 min 40 sec | 8 | 0 | 20-60 | −4 | 20-300 psi/ 30 sec. | 6 | −4 psi | Operating compressor, having no problem |
| | | | | | | Total Production Increase | | | | | | 6 | | |

As it can be seen from the table above, the pressure without the compressor or pumping unit was 3 psi, changing to −4 (four negative) psi by using the compressor or pumping unit of the present invention, resulting consequently that, that difference of vacuum pressure allows a greater production.

Using the Compressor Unit of the Invention:

| Date | | Battery | $P_{Pipe}$ | $P_{Casing}$ | Well details | | | | Fluid level (FLAP) | | | PPRL | Torque | Dynamometric card | Remarks | Recommendation |
|---|---|---|---|---|---|---|---|---|---|---|---|---|---|---|---|---|
| Oct. 22nd, | October | 4537 | 10 @ 280 psi/2' 40" | 2.9 | 1374' | 36" | 3.58 | 24 | 1345' | 29' | 29' | 1,993 | 15,977 | Card has fluid | Card has fluid | Decrease working |

-continued

| Date | Battery | $P_{Pipe}$ | $P_{Casing}$ | Well details | Fluid level (FLAP) | PPRL | Torque | Dynamometric card | Remarks | Recommendation |
|---|---|---|---|---|---|---|---|---|---|---|
| 2016 | | | | | | | | pound. | pound. | time to 20 × 4. |

One can remarkably observe an increase of the production from 2 BOPD to 8 BOPD, operating 24 hours under the same extraction conditions as those prior to the use of the compressor unit, thus obtaining better manometric tests.

In this way, the compressor unit for oil wells of the present invention is constituted and constructed, which is independent from the operation of the AIB rod pump and in turn, it allows the variation of the piston moving speed to extract a greater or lesser amount of gas in accordance with the existing pressure in the well annulus owing to the novel arrangement of the pressure transmitter and pressure switch. That is to say, the pressure is programmable, this being not possible with any conventional mechanism of the prior art. It is emphasized that the gas extraction cycle is continuous during the period of oil extraction.

Furthermore, some of the advantages of the unit of the present invention lie in:

The use of an external and independent compressor unit instead of a traditional reciprocating gas compressor CGBD (mechanical pumping), allows to further reduce gas pressure in the well annulus since its action is not limited by the geometry of the pumping rod unit, nor the low GPM (<9), wherein independence of frequency of action of the compressor unit allows it to be smaller;

The compressor unit allows maintaining a constant gas pressure in the well, since it has the pressure switch and pressure transmitter that controls the piston speed according to the gas flow to be extracted, pressure being programmable;

Higher gas extraction capacity;

Increases production, with less flowing pressure;

Increase in recoverable reserves (vacuum in annulus);

Easy installation and transfer of the compressor unit;

It does not generate imbalance in alignment and balancing in a mechanical compressor unit;

Totally compact compressor unit (small dimensions) reducing the risk of accidents (there is no work at height);

Easy acquisition of spare parts;

Durability of materials used in its manufacture;

In case of maintenance of the compressor cylinder, it is replaced in approximately 30 minutes by another backup unit;

It is not necessary to stop the AIB rod pump;

The unit of the invention is environment friendly since it does not generate excessive noise;

It is not obstructive as it occupied little physical space in the well's location;

Compact compressor cylinder (fewer parts and flanges with uniform adjustment); improved metallurgy (high quality steel and aluminum), last generation seals (in stuffing box, flanges and piston)

Graphite Teflon seals for greater efficiency and durability;

Compressor accessories (horizontal check valves, bends, tee's, tubes, etc.) designed to work in media with gas flow;

Decrease in manufacturing cost; and

Longer useful life and efficiency of the compressor unit due to less maintenance and repairs, among many other advantages.

Thus, the invention allows varying the piston drive amount according to what we want by means of the variable speed drive that drives the motor and without depending on the frequency of actuation of the mechanical pumping as it occurs with the units of the prior art. In turn, the unit of the invention allows the compressor to be smaller since there being more frequency a smaller compressor is needed, thus allowing regulating the gas pressure of the well as desired owing to the arrangement of the pressure switch and pressure transmitter connected to the casing that, according to the desired programmed pressure, varies the speed of the motor that drives the compressor and therefore extracts more or less gas.

I claim:

1. A gas compressor unit for oil wells, the gas compressor unit comprising:

a base;

a stand element in the base;

a rotary drive motor mounted in an upper end of the stand element;

an output rotary shaft of said rotary drive motor;

a connecting rod having an end affixed to said output rotary shaft to rotate with the output rotary shaft, and an opposite end including a first bearing;

at least one compressor cylinder having a first end and a second end, with the second end pivotally connected to a support fixed in the base, and a double-acting piston having a driving shaft with a proximal end that is rotably connected to said opposite end of the connecting rod through the first bearing for moving the double-acting piston with reciprocating movement;

at least one first gas inlet/outlet port in the first end of the compressor cylinder;

at least one second gas inlet/outlet port in the second end of the compressor cylinder;

a valves framework affixed to the base, the valves framework having a first framework port connected by a first flexible conduit to the first gas inlet/outlet port of the compressor cylinder and a second framework port connected by a second flexible conduit to the second gas inlet/outlet port of the compressor cylinder, a discharge branch and a suction branch, the discharge branch having a pair of discharge check valves and a discharge branch port between the discharge check valves, the suction branch having a pair of suction check valves and a suction branch port between the suction check valves;

a liquid separator having a first end connected to the suction branch port and a second end connected to a suction hose; and a gas venting tube connected to security valves and between the liquid separator and the discharge branch port, wherein said security valves are a first security valve connected between the liquid separator and the gas venting tube, and a second security valve connected between the gas venting tube and the discharge branch port.

2. The gas compressor unit of claim 1, wherein said second end of the compressor cylinder has a lower arm provided with a second bearing to pivot around a shaft in the support that is stationary affixed to the base.

3. The gas compressor unit of claim 1, wherein said rotary drive motor is connected to a pressure transmitter operatively connected to a pressure switch which in turn is operatively connectable to the well.

4. The gas compressor unit of claim 1, wherein a suction pressure sensor is connected to at least one of the liquid separator and the suction branch port.

5. The gas compressor unit of claim 1, wherein a discharge pressure sensor is connected between the discharge hose and the second security valve.

6. The gas compressor unit of claim 1, wherein the discharge check valves and the suction check valves are unidirectional check valves.

7. The gas compressor unit of claim 1, wherein said rotary drive motor is an electric motor.

8. The gas compressor unit of claim 1, wherein said rotary drive motor is connected to a motor gear reducer.

9. The gas compressor unit of claim 1, further comprising a connection element rotatably connected to said opposite end of the connecting rod through the first bearing.

* * * * *